US010076224B2

(12) United States Patent
Poojary et al.

(10) Patent No.: US 10,076,224 B2
(45) Date of Patent: Sep. 18, 2018

(54) DISHWASHER

(71) Applicant: Whirlpool Corporation, Benton Harbor, MI (US)

(72) Inventors: Praveen Poojary, Saint Joseph, MI (US); Barry E. Tuller, Stevensville, MI (US); Chad T. Vanderroest, Covert, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 781 days.

(21) Appl. No.: 14/159,021

(22) Filed: Jan. 20, 2014

(65) Prior Publication Data

US 2015/0201823 A1 Jul. 23, 2015

(51) Int. Cl.
*A47L 15/16* (2006.01)
*A47L 15/42* (2006.01)

(52) U.S. Cl.
CPC ..... *A47L 15/16* (2013.01); *A47L 15/428* (2013.01); *A47L 15/4219* (2013.01)

(58) Field of Classification Search
CPC ..... A47L 15/16; A47L 15/22–15/23
See application file for complete search history.

(56) References Cited

U.S. PATENT DOCUMENTS 1,598,352 A 8/1926 Kehoe et al.
1,897,821 A 2/1933 Poli
2,407,533 A 9/1946 Brock
2,918,927 A 12/1959 Clearman
3,060,944 A 10/1962 Brollo
3,095,885 A 7/1963 Hertell
3,217,721 A 11/1965 Hertel
3,253,784 A 5/1966 Long et al.
3,285,779 A 11/1966 Dunham
3,468,486 A 9/1969 Mercer
3,586,011 A 6/1971 Mazza
3,648,931 A 3/1972 Jacobs
3,718,149 A 2/1973 Mazza
3,828,818 A 8/1974 Hunt
3,915,180 A 10/1975 Jacobs
4,094,702 A 6/1978 Rabuffetti
(Continued)

FOREIGN PATENT DOCUMENTS

BR PI0505649 A 9/2006
BR PI0506303 A 7/2007
(Continued)

OTHER PUBLICATIONS

Bosch User Manual for Dishwasher, p. 22, Downloaded from boschappliances.com on Feb. 15, 2005.
(Continued)

*Primary Examiner* — Spencer E Bell
(74) *Attorney, Agent, or Firm* — McGarry Bair PC

(57) ABSTRACT

A dishwasher for treating dishes includes a tub at least partially defining a treating chamber, a spraying system having a manifold with at least one sprayer for spraying wash liquid into the treating chamber, and a recirculation system for recirculating liquid sprayed in the treating chamber to the spraying system. The sprayer of the manifold has multiple apertures which are configured to emit liquid to different areas of the treating chamber.

26 Claims, 15 Drawing Sheets

(56) References Cited

U.S. PATENT DOCUMENTS

| | | | | |
|---|---|---|---|---|
| 4,172,463 | A * | 10/1979 | Woolley | A47L 15/4255 134/176 |
| 4,279,384 | A | 7/1981 | Yamamoto | |
| 4,320,781 | A | 3/1982 | Bouvet et al. | |
| 5,131,419 | A | 7/1992 | Roberts | |
| 5,264,043 | A | 11/1993 | Milocco | |
| 5,331,986 | A | 7/1994 | Lim et al. | |
| 5,494,062 | A | 2/1996 | Springer | |
| 5,497,798 | A | 3/1996 | Fritz et al. | |
| 5,542,443 | A | 8/1996 | Yura et al. | |
| 5,849,101 | A | 12/1998 | Edwards et al. | |
| 6,003,529 | A | 12/1999 | Perry, Jr. | |
| 6,432,216 | B1 | 8/2002 | Thies | |
| 6,491,049 | B1 | 12/2002 | Tuller et al. | |
| 6,666,220 | B2 | 12/2003 | Spanyer et al. | |
| 6,869,029 | B2 | 3/2005 | Ochoa, Sr. et al. | |
| 7,270,132 | B2 | 9/2007 | Inui et al. | |
| 7,331,356 | B2 | 2/2008 | Vanderroest et al. | |
| 7,445,013 | B2 | 11/2008 | VanderRoest et al. | |
| 7,475,696 | B2 | 1/2009 | Vanderroest et al. | |
| 7,523,758 | B2 | 4/2009 | Vanderroest et al. | |
| 7,594,513 | B2 | 9/2009 | VanderRoest et al. | |
| 7,947,132 | B2 | 5/2011 | Vanderroest et al. | |
| 8,137,479 | B2 | 3/2012 | Vanderroest et al. | |
| 8,187,390 | B2 | 5/2012 | Vanderroest et al. | |
| 8,454,762 | B2 | 6/2013 | Vanderroest et al. | |
| 8,454,763 | B2 | 6/2013 | Vanderroest et al. | |
| 2004/0173249 | A1 | 9/2004 | Assmann et al. | |
| 2004/0255982 | A1* | 12/2004 | VanderRoest | A47L 15/16 134/25.2 |
| 2004/0255992 | A1 | 12/2004 | Rudiger | |
| 2005/0022847 | A1 | 2/2005 | Nito et al. | |
| 2005/0150529 | A1 | 7/2005 | Vanderroest et al. | |
| 2005/0224098 | A1 | 10/2005 | Fujii et al. | |
| 2006/0054198 | A1 | 3/2006 | Choi | |
| 2007/0056613 | A1 | 3/2007 | Haas et al. | |
| 2007/0119485 | A1 | 5/2007 | Gunnerson et al. | |
| 2009/0159103 | A1 | 6/2009 | Gillum et al. | |
| 2011/0030742 | A1 | 2/2011 | Dalsing et al. | |
| 2011/0114139 | A1 | 5/2011 | Buesing et al. | |
| 2012/0111376 | A1* | 5/2012 | Worrasangasilpa | A47L 15/4217 134/104.2 |
| 2012/0125381 | A1 | 5/2012 | Vanderroest et al. | |
| 2012/0125382 | A1 | 5/2012 | Vanderroest et al. | |
| 2012/0138100 | A1 | 6/2012 | Chen et al. | |
| 2012/0138110 | A1 | 6/2012 | Chen et al. | |
| 2013/0092194 | A1 | 4/2013 | Carlson et al. | |
| 2013/0139859 | A1* | 6/2013 | Park | A47L 15/428 134/198 |

FOREIGN PATENT DOCUMENTS

| | | | |
|---|---|---|---|
| CA | 2527846 | A1 | 6/2006 |
| CA | 2527848 | A1 | 6/2006 |
| CN | 1182570 | A | 5/1998 |
| DE | 7417444 | U | 10/1974 |
| DE | 2911005 | A1 | 9/1980 |
| DE | 3403359 | A1 | 8/1985 |
| DE | 10124645 | A1 | 12/2001 |
| DE | 102006012453 | A1 | 10/2006 |
| DE | 102012217566 | A1 | 3/2013 |
| EP | 0291713 | A1 | 11/1988 |
| EP | 0517015 | A1 | 12/1992 |
| EP | 0755650 | A1 | 1/1997 |
| EP | 0786230 | A2 | 7/1997 |
| EP | 795292 | A2 | 9/1997 |
| EP | 1040787 | A1 | 10/2000 |
| EP | 1252856 | A2 | 10/2002 |
| EP | 1264570 | A1 | 12/2002 |
| EP | 1488730 | A1 | 12/2004 |
| EP | 1676520 | A2 | 7/2006 |
| EP | 1676521 | A2 | 7/2006 |
| EP | 2583611 | A2 | 4/2013 |
| ES | 2321711 | T3 | 6/2009 |
| ES | 2340859 | T3 | 6/2010 |
| GB | 668181 | A | 3/1952 |
| GB | 2295535 | A | 6/1996 |
| JP | 11076127 | A | 3/1999 |
| JP | 2001218721 | A | 8/2001 |
| JP | 2002065562 | A | 3/2002 |
| JP | 2002219088 | A | 8/2002 |
| JP | 2007105210 | A | 4/2007 |
| KR | 19950003025 | | 2/1995 |
| KR | 19970064554 | | 10/1997 |
| KR | 19980031929 | | 8/1998 |
| KR | 19990031442 | | 7/1999 |
| KR | 20040006218 | A | 1/2004 |
| KR | 200366704 | | 10/2004 |
| KR | 20050122359 | A | 12/2005 |
| KR | 20060013790 | A | 2/2006 |
| KR | 20060087396 | A | 8/2006 |
| KR | 100842370 | B1 | 6/2008 |
| KR | 20080083911 | A | 9/2008 |
| KR | 2009014510 | A | 2/2009 |
| MX | PA05013870 | A | 6/2006 |
| MX | PA05013873 | A | 6/2006 |
| WO | 0022973 | A1 | 4/2000 |
| WO | 2004058035 | A1 | 7/2004 |

OTHER PUBLICATIONS

The Perfect Ten, 2005 American Building Product Awards, Home Magazine, homemag.com, Published Feb. 2005.

Asko Unveils New Dishwasher, Appliance Magazine, Published May 8, 2003, Downloaded From appliancemagazine.com Sep. 26, 2005.

Dishwashers, Power at a Price, Consumer Reports, p. 34, Published Mar. 2005.

Bosch SHU43 Built-in Dishwasher, epinions.com, Published Jan. 26, 2001.

First Look, Power Washer, p. 91, Good Housekeeping Magazine, Published Sep. 2004.

USPTO Notice of Intent to Issue a Reexam Certificate for U.S. Appl. No. 96/000,044, dated Mar. 19, 2014.

European Search Report for Corresponding EP15151651.5, Jun. 1, 2015.

European Search Report for Corresponding EP12158456.9, dated Dec. 6, 2017.

* cited by examiner

DISHWASHER

BACKGROUND OF THE INVENTION

Contemporary automatic dishwashers for use in a typical household include a tub and at least one rack or basket for supporting soiled dishes within the tub. A spraying system may be provided for recirculating liquid throughout the tub to remove soils from the dishes. In less common configurations, the spraying system may include various sprayers including one or more rotatable sprayers and one or more stationary sprayers.

An upper rack and a lower rack for holding dishes to be cleaned are typically provided within the treating chamber. A silverware basket for holding utensils, silverware, etc. is also usually provided and normally removably mounts to the door or within the lower rack. Various sprayers of the spraying system can be configured to spray toward the racks or silverware basket.

BRIEF DESCRIPTION OF THE INVENTION

The invention relates to a dishwasher for treating dishes according to an automatic cycle of operation. In one aspect of the invention, the dishwasher includes a tub at least partially defining a treating chamber and having an open face providing access to the treating chamber and a sump, a door selectively closing the open face, a lower dish rack located within the treating chamber, an upper dish rack located within the treating chamber above the lower dish rack, a spraying system, and a recirculation system for recirculating liquid sprayed in the treating chamber from the sump to the spraying system. The spraying system includes a lower rotating sprayer located within the treating chamber beneath the lower dish rack, an upper rotating sprayer located within the treating chamber beneath the upper dish rack, and a manifold located within the treating chamber and having a first sprayer with multiple apertures. A first aperture of the multiple apertures is configured to emit a spray of liquid directly onto a dish adjacent to the manifold in the lower dish rack and a second aperture of the multiple apertures is configured to emit an arcing spray of liquid over the dish adjacent to the manifold in the lower dish rack.

In yet another aspect of the invention, the dishwasher includes a tub at least partially defining a treating chamber and having an open face providing access to the treating chamber and a sump, a door selectively closing the open face, a lower dish rack located within the treating chamber, an upper dish rack located within the treating chamber above the lower dish rack and having four corners, a spraying system, and a recirculation system for recirculating liquid sprayed in the treating chamber from the sump to the spraying system. The spraying system includes a lower rotating sprayer located within the treating chamber beneath the lower dish rack, an upper rotating sprayer located within the treating chamber beneath the upper dish rack, and a manifold located within the treating chamber and having a first sprayer with multiple apertures. A first aperture of the multiple apertures is configured to emit a spray of liquid downwardly into the lower dish rack and a second aperture of the multiple apertures is configured emit a spray of liquid upwardly into one of the four corners of the upper dish rack.

DESCRIPTION OF EMBODIMENTS OF THE INVENTION

Figure 1:
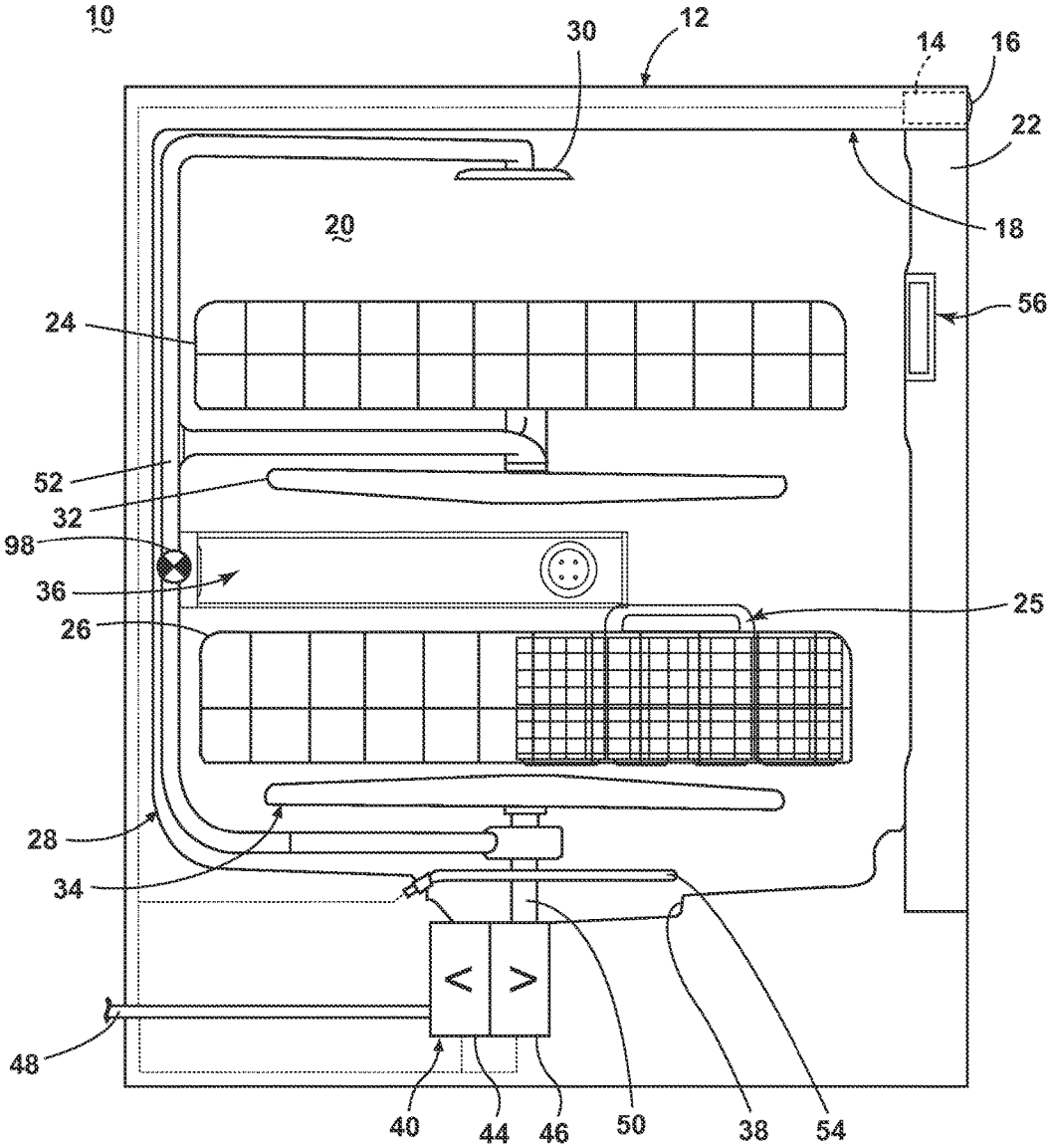
FIG. 1 is a schematic, cross-sectional view of a dishwasher with a spraying system according to one embodiment of the invention.

In FIG. 1, an automated dishwasher 10 according to one embodiment of the invention is illustrated. The dishwasher 10 can treat dishes according to an automatic cycle of operation. Depending on whether the dishwasher 10 is a stand-alone or built-in, the dishwasher includes a cabinet 12 that may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware.

An additional utensil holder, such as a silverware basket 25 is also located within the treating chamber 20 and receives utensils for being treated. As used in this description, the term "utensil(s)" is intended to be generic to any item, single or plural, that may be placed in the silverware basket 25 for treatment in the dishwasher 10, including, without limitation; forks, knives, spoons, chopsticks, spatulas, tongs, whisks, etc. The silverware basket 25 can be removably mounted to the lower rack 26. As another option, the silverware basket 25 could be positioned in the upper rack 24. As yet another option, the silverware basket 25 could be provided on the interior of the door 22 instead of either rack 24, 26.

A spraying system 28 may be provided for spraying liquid into the treating chamber 20 and is illustrated in the form of a top sprayer 30, an upper rotatable sprayer 32, a lower rotatable sprayer 34, and a distribution header 36. The top sprayer 30 may be located above the upper rack 24 and is illustrated as a fixed spray nozzle that sprays liquid downwardly within the treating chamber 20. The upper rotatable sprayer 32 is located between the upper rack 24 and the lower rack 26 and is illustrated as a rotating spray arm. The upper spray arm 32 may provide a liquid spray upwardly through the bottom of the upper rack 24. The upper rotatable sprayer 32 may optionally also provide a liquid spray downwardly onto the lower rack 26, but for purposes of simplification, this will not be illustrated herein. The lower rotatable sprayer 34 is located underneath the lower rack 26 and is illustrated as a rotating spray arm. The lower spray arm 34 may provide a liquid spray upwardly through the bottom of the lower rack 26.

The number, configuration, and location of the sprayers for the spraying system 28 can vary from the exemplary spraying system 28 shown herein. For example, rather than rotating arms or fixed nozzles, any of the sprayers 30, 32, 34 can be configured as various other types of sprayers, such as, but not limited to, one or more rotating spray discs, fixed spray jets in one or more of the upper rack 24, lower rack 26, and silverware basket 25, or one or more tower sprayers.

The distribution header 36 may be fixedly mounted to the tub 18 adjacent one of both of the racks 24, 26, and as shown herein is provided between the racks 24, 26. The distribution header 36 may not be limited to this position; rather, the distribution header 36 may be located in virtually any part of the treating chamber 20. The distribution header 36 may emit liquid toward one or both of the racks 24, 26.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the distribution header 36, upper rotatable sprayer 32, and top sprayer 30 through a supply tube 52 that extends generally rearward from the recirculation pump 46 and upwardly along a rear wall of the tub 18. While the supply tube 52 ultimately supplies liquid to the distribution header 36, upper rotatable sprayer 32, and top sprayer 30, it may fluidly communicate with one or more manifold tubes that directly transport liquid to the distribution header 36, upper rotatable sprayer 32, and top sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

Additional functional systems may be provided for the dishwasher 10. For example, a heating system having a heater 54 may be located within or near the sump 38 for heating liquid contained in the sump 38. A dispensing system 56, which may dispense a detergent during the wash step of the cycle of operation or a rinse aid during the rinse step of the cycle of operation, may be located within the dishwasher 10, such as on an inner surface of the door. A filtering system (not shown) may be fluidly coupled with the recirculation flow path for filtering the recirculated liquid.

Figure 2:
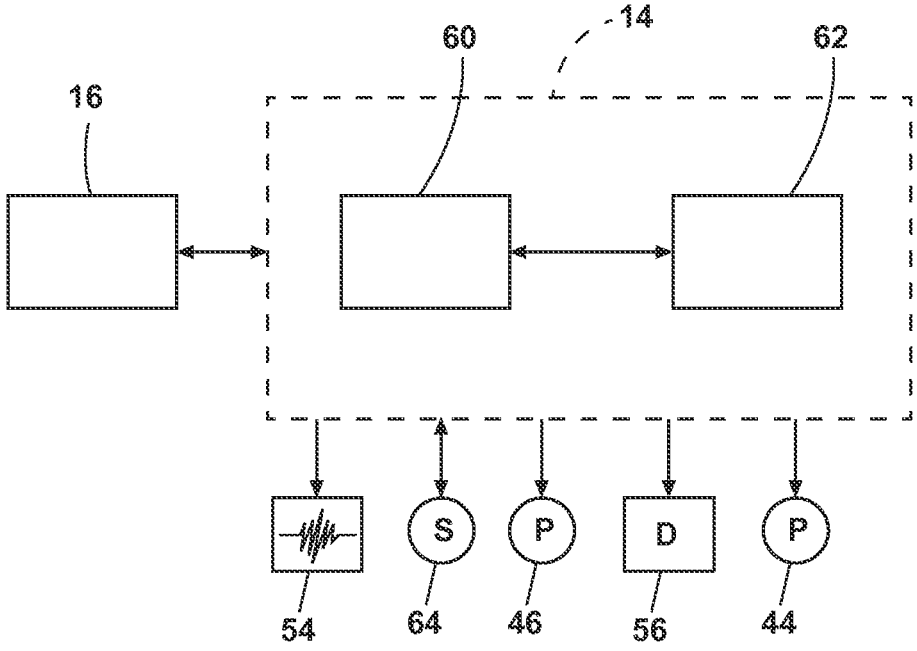
FIG. 2 is a schematic view of a control system of the dishwasher of FIG. 1.

As illustrated in FIG. 2, the controller 14 may be provided with a memory 60 and a central processing unit (CPU) 62. The memory 60 may be used for storing control software that may be executed by the CPU 62 in completing a cycle of operation using the dishwasher 10 and any additional software. For example, the memory 60 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54 and the dispensing system 56. The controller 14 may also be coupled with one or more optional sensors 64. Non-limiting examples of optional sensors 64 that may be communicably coupled with the controller 14 include a moisture sensor, a door sensor, a temperature sensor, a detergent and rinse aid presence/type sensor(s).

Figure 3:
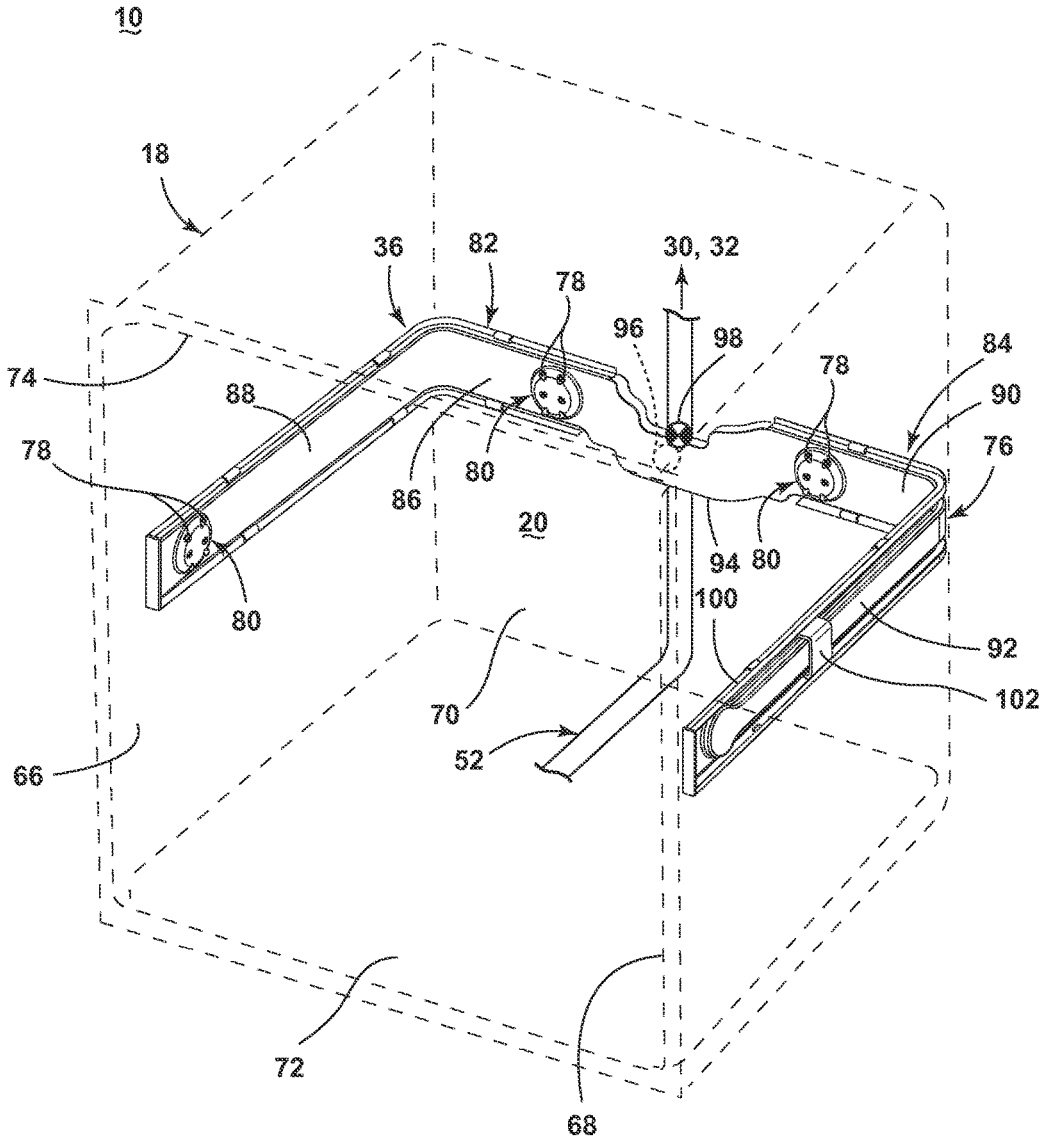
FIG. 3 is a perspective view of the dishwasher from FIG. 1, with internal components removed for clarity to show a manifold of the spraying system.

FIG. 3 is a perspective view of the dishwasher 10 of FIG. 1, illustrating the distribution header 36 within the tub 18, with the tub 18 shown in phantom line and internal components such as the dish racks 24, 26 and sprayers 30, 32, 34 removed for clarity. The tub 18 includes opposing left and right side walls 66, 68 joined by a rear wall 70, a bottom wall 72, and a top wall 74 which together defines the treating chamber 20.

The distribution header 36 includes a manifold 76 with multiple apertures 78 for spraying liquid into the treating chamber 20. The apertures 78 can be provided on at least one sprayer 80 fluidly coupled to the manifold 76. The sprayer 80 may be fixed or rotatable with respect to the tub 18, and may be in the form of a disc-shaped nozzle, although other configurations of the sprayer 80 are possible. As illustrated herein, the manifold 76 may include multiple fixed sprayers 80, each having multiple apertures 78 configured to spray wash liquid outwardly from the manifold 76. The sprayers 80 may be fixedly mounted to the manifold 76, such that the sprayers 80 remain stationary when liquid is emitted from the apertures 78.

The manifold 76 can be in fluid communication with the supply tube 52 for receiving liquid recirculated by the recirculation system, and can define a hollow passage through which liquid may flow to the sprayers 80 and out the apertures 78. The manifold 76 extends along at least one wall of the tub 18. As shown herein, the manifold 76 extends along the rear wall 70 and along at least a portion of the left and right side walls 66, 68. The manifold 76 can have a generally U-shaped body with two opposing portions 82, 84 positioned on opposite sides of the supply tube 52. The left opposing portion 82 includes a left rear segment 86 extending laterally from the supply tube 52 along the rear wall 70 of the tub 18 and a left side segment 88 extending along the left side wall 66 of the tub 18. The right opposing portion 84 includes a right rear segment 90 extending laterally from the supply tube 52 along the rear wall 70 of the tub 18 and a right side segment 92 extending along the right side wall 68 of the tub 18. The side segments 88, 92 can be substantially flush with the side walls 66, 68 of the tub 18, while the rear segments 86, 90 can meet to form a central bowed portion 94 to accommodate for the passage of the supply tube 52 upwardly to fluidly couple with the top and upper sprayers 30, 32.

The bowed portion 94 can also have a port 96 through which liquid may be supplied from the supply tube 52 to the opposing portions 82, 84 of the manifold 76. A valve 98 may be provided in the supply tube 52 for controlling the delivery of liquid to the manifold 76 and the top and upper sprayers 30, 32. The valve 98 can be configured to permit liquid delivery to all three at one time, only to the manifold 76, or only to the top and upper sprayers 30, 32. The valve 98 can be operably coupled with the controller 14 (FIG. 2) and may be automatically controlled according to the cycle of operation. Alternatively or additionally, an operational control for selecting the manifold spray action can be provided on the user interface 16 to allow the user to manually select to use the manifold 76 for a cycle. While shown as being positioned at substantially the same height as the manifold 76, the valve 98 can be positioned anywhere in the supply tube 52 which permits the valve to control the delivery of liquid to the manifold 76 and the top and upper sprayers 30, 32.

As illustrated, two sprayers 80 are provided on each opposing portion 82, 84, with one sprayer 80 provided on the left rear segment 86, one sprayer 80 provided on the left side segment 88, one sprayer 80 provided on the right rear segment 90, and one sprayer 80 provided on the right side segment 92, although the right side sprayer 80 is not visible in FIG. 3. Of course, other configurations of sprayers 80 are possible.

In the illustrated embodiment, the manifold 76 is provided on an outer face of the distribution header 36, which can also have a generally U-shape body extending horizontally along the rear wall 70 of the tub 18 and along the side walls 66, 68 of the tub 18. The inner face of the distribution header 36 opposite the manifold 76 can optionally form a cover 100 for the manifold 76, with the sprayers 80 provided on the exterior of the cover 100. The cover 100 can provide food particles and other debris from getting trapped behind the manifold 76. The manifold 76 and the cover 100 can be integrally formed with each other. The manifold 76 and the integral cover 100 can be coupled with the tub 18 in any suitable manner; as shown herein, one or more brackets 102 can be used to attach the manifold 76 to the tub 18.

Figure 4:
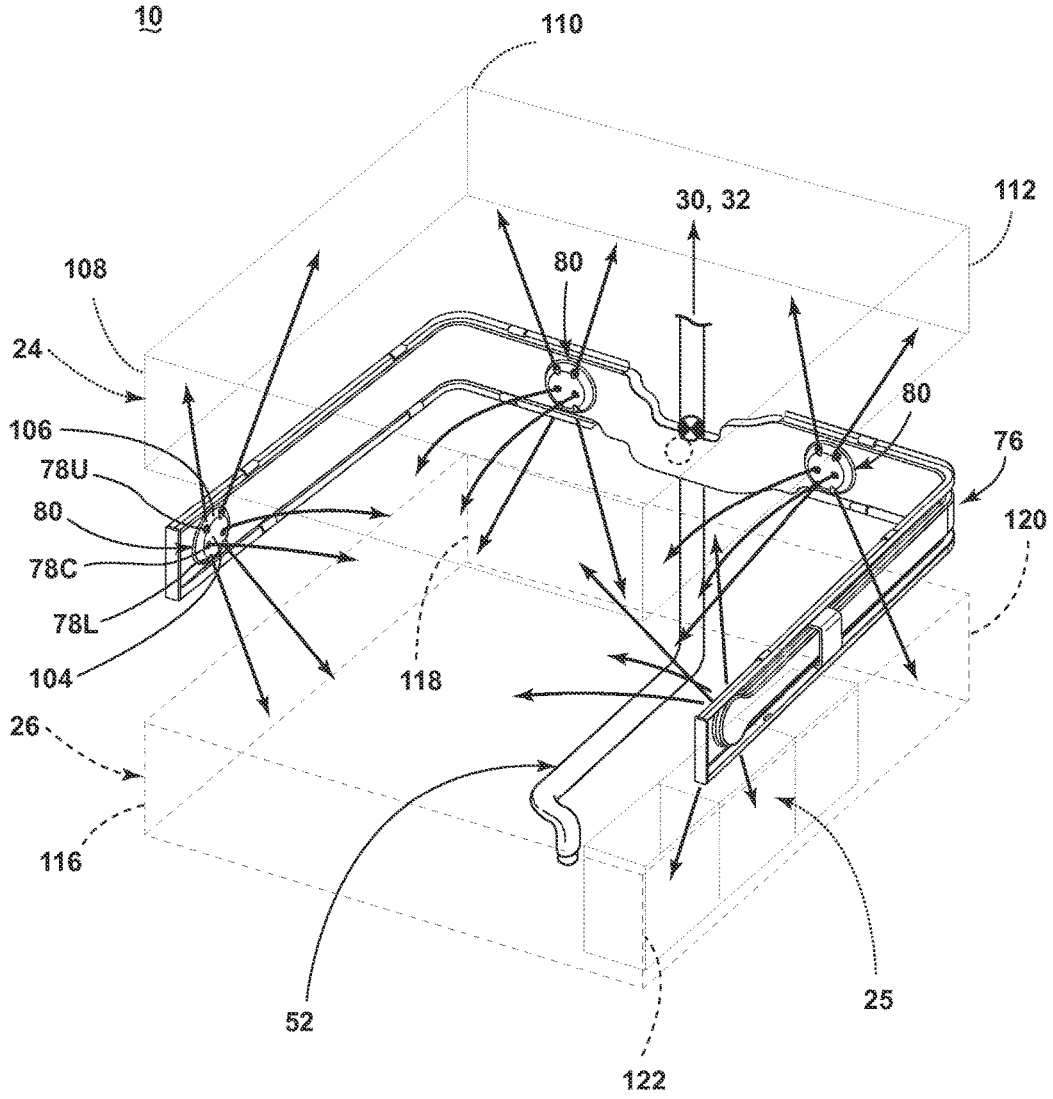
FIG. 4 is a perspective view of the dishwasher from FIG. 1, with the tub and internal components removed for clarity to show the pattern of liquid emitted from the manifold.

FIG. 4 is a perspective view of the dishwasher 10, with the tub and internal components removed for clarity to show the pattern of liquid emitted from the manifold 76 with respect to the racks 24, 26 and silverware basket 25. The apertures 78 of the manifold 76 can be configured to spray in different directions in order to provide full coverage of the dishes being treated. For example, a group of lower apertures 78L emit a spray of liquid downwardly into the lower dish rack 26, a group of upper apertures 78U emit a spray of liquid upwardly into the upper dish rack 24, and a group of central apertures 78C emit a spray of liquid arcing into the lower dish rack 26.

In the illustrated embodiment, the sprayers 80 include a face 104 defining a periphery 106, and the group of lower apertures 78L is located on a lower portion of the periphery 106 and oriented to spray liquid in a path along a substantially downward angle relative to the sprayer 80, the group of upper apertures 78U is located on an upper portion of the periphery 106 and oriented to spray liquid in a path along a substantially upward angle relative to the sprayer 80, and the group of central apertures 78C is located on the face 104 between the upper and lower apertures 78U, 78L and oriented to spray liquid in a path along a substantially outward curve relative to the sprayer 80. While each group is shown as including multiple apertures 78, any of the groups could instead include a single aperture.

The upper dish rack 24 has four corners, a left front corner 108, a left rear corner 110, a right rear corner 112, and a right front corner 114, and at least one of the upper apertures 78U emits a spray of liquid upwardly into at least one of the four corners 108-114 of the upper dish rack 24. As shown, the left side sprayer 80 has at least one upper aperture 78U which emits a spray of liquid into the left front corner 108, the left rear sprayer 80 has at least one upper aperture 78U which emits a spray of liquid into the left rear corner 110, right left rear sprayer 80 has at least one upper aperture 78U which emits a spray of liquid into the right rear corner 112, and the right side sprayer 80 has at least one upper aperture 78U which emits a spray of liquid into the right front corner 114. Other upper apertures 78U on the sprayers 80 may emit liquid to other zones of the upper dish rack 24.

Likewise, the lower rack 26 has four corners, a left front corner 116, a left rear corner 118, a right rear corner 120, and a right front corner 122, and at least one of the upper apertures 78U emits a spray of liquid downwardly into at least one of the four corners 116-122 of the lower dish rack 26. As shown, the left side sprayer 80 has at least one lower aperture 78L which emits a spray of liquid into the left front corner 116, the left rear sprayer 80 has at least one lower aperture 78L which emits a spray of liquid into the left rear corner 118, right left rear sprayer 80 has at least one lower aperture 78L which emits a spray of liquid into the right rear corner 120, and the right side sprayer 80 has at least one lower aperture 78L which emits a spray of liquid into the right front corner 114. Other lower apertures 78L on the sprayers 80 may emit liquid to other zones of the upper dish rack 24. For example, the silverware basket 25 is shown as being located on the right side of the lower dish rack 26, and one or more of the lower apertures 78L can be configured to emit liquid into the silverware basket 25. As shown, the right side sprayer 80 may emit liquid into one or more zones of the silverware basket 25.

Figure 5:
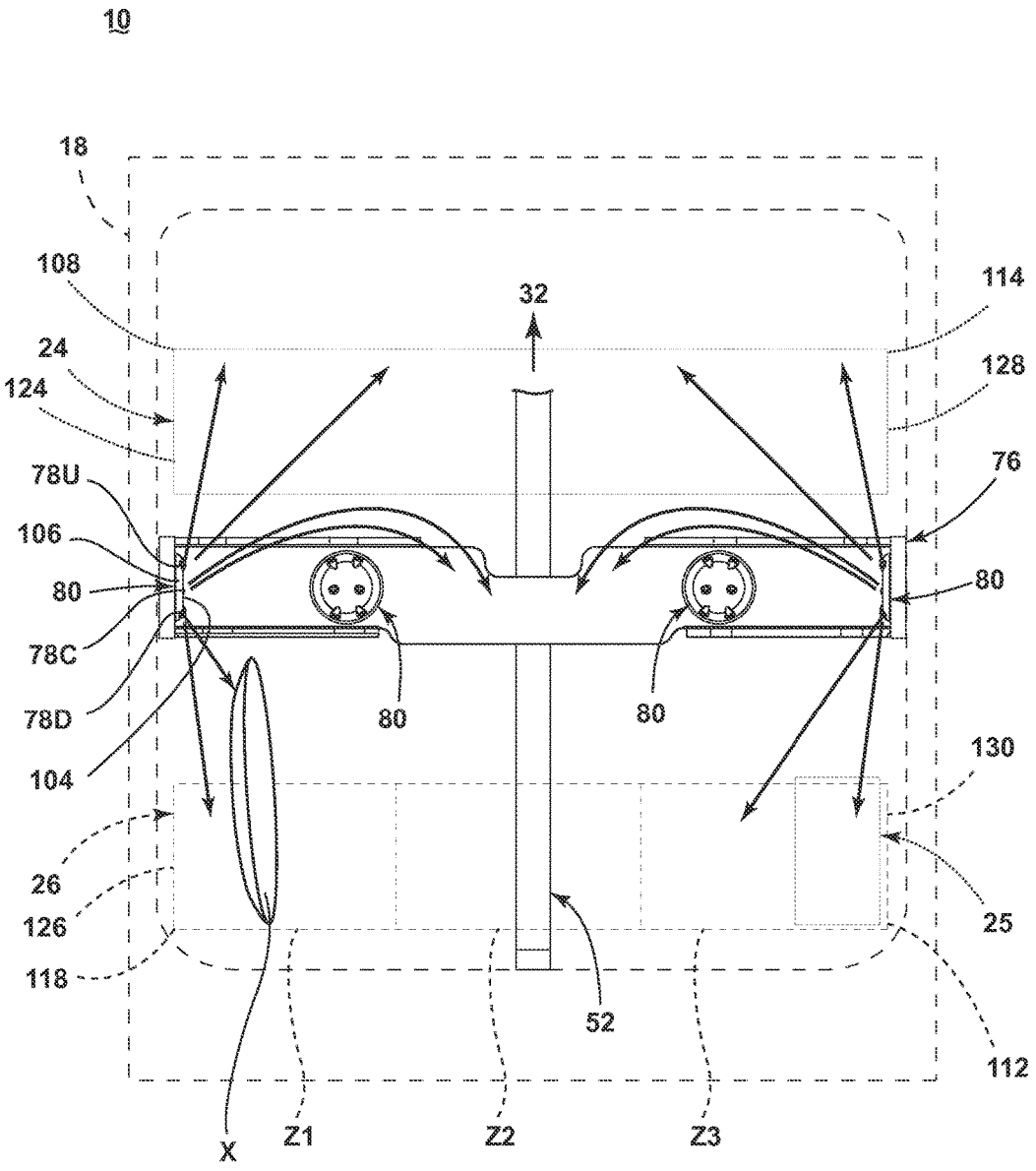
FIG. 5 is a front view of the dishwasher of FIG. 4, showing the pattern of liquid emitted from the manifold.

FIG. 5 is a front view of the dishwasher 10 showing the pattern of liquid emitted from the manifold 76. In FIG. 5, only the spray patterns of liquid emitted from the left and ride side sprayers 80 are illustrated for clarity. The sprayers 80 are located between the disk racks 24, 26, with the left side sprayer 80 is located on the left sides 124, 126 of the dish racks 24, 26, and the right side sprayer 80 is located on the right sides 128, 130 of the dish racks 24, 26, opposite the left sides 124, 126, respectively.

The lower dish rack 26 can be conceptually divided into multiple zones, including a first zone Z1 adjacent the left side 126 of the lower dish rack 26, a second zone Z2 near a middle portion of the rack 26, and a third zone Z3 adjacent the right side 130 of the lower dish rack 26. An exemplary dish X is shown as being loaded in the first zone Z1 adjacent to the manifold 76 and the silverware basket 25 is shown as being provided in the third zone Z3.

The lower apertures 78L on the left side sprayer 80 emit a spray of liquid directly into the first zone Z1 and onto the dish X in the lower dish rack 26, while the central apertures 78C on the left side sprayer 80 emit an arcing spray of liquid over the dish X into the second zone Z2. The lower apertures 78L on the right side sprayer 80 emit a spray of liquid directly into the third zone Z3 and into the silverware basket 25, while the central apertures 78C on the right side sprayer 80 an arcing spray of liquid over the silverware basket 25 into the second zone Z2.

The spray paths from the left side sprayer 80 into the first and second zones Z1, Z2 can be configured such that they do not intersect in the lower dish rack 26 in order to maximize the area of the lower dish rack 26 covered by the manifold 76. Likewise, the spray paths from the right side sprayer 80 into the second and third zones Z2, Z3 can be configured such that they do not intersect in the lower dish rack 26. However, the arcing spray paths of liquid from the left and right side sprayers 80 into the second zone Z2 may at least both reach the middle of the lower dish rack 26, and may even overlap each other in the second zone Z2 in order to provide full coverage of the lower dish rack 26 in conjunction with the other apertures 78.

For FIGS. 4-5, it is understood that the lines drawn from the apertures 78 represent the main flow path for the emitted liquid, and that some emitted liquid may deviate from the main flow path along a higher or lower trajectory than depicted in the figures in order to effect good coverage of the racks 24, 26 and silverware basket 25.

Figure 6:
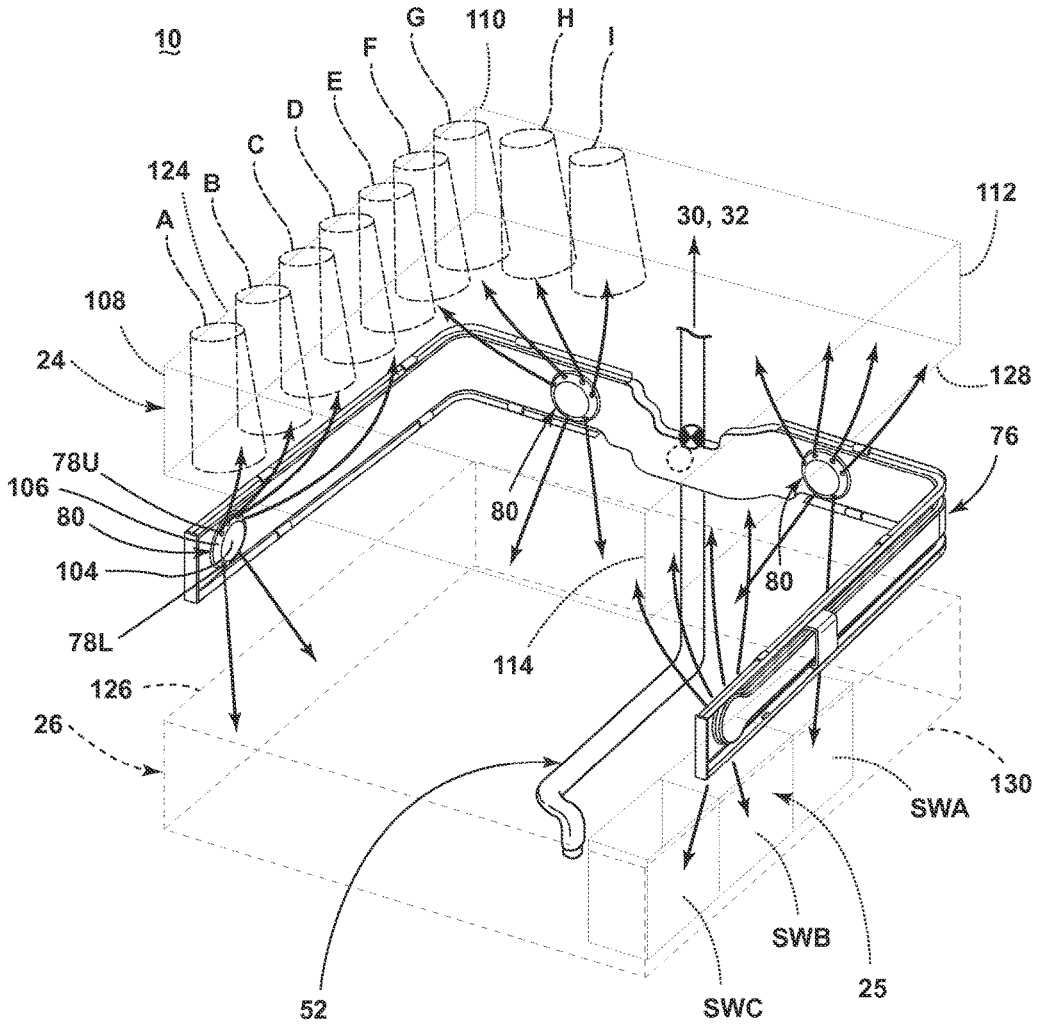
FIG. 6 is a perspective of a dishwasher, with internal components removed for clarity to show a manifold, according to a second embodiment of the invention.

FIG. 6 is a perspective of a dishwasher 10 according to a second embodiment of the invention, with the tub and internal components removed for clarity to show the pattern of liquid emitted from the manifold 76 with respect to the racks 24, 26 and silverware basket 25. The second embodiment can be substantially similar to the first embodiment shown in FIGS. 1-5, save for the arrangement of apertures 78 on the sprayers 80 and the pattern of liquid emitted from the manifold 76. As shown, the apertures 78 of the manifold 76 can be configured to spray in different directions in order to provide full coverage of the dishes being treated. For example, a group of lower apertures 78L emit a spray of liquid downwardly into the lower dish rack 26 and a group of upper apertures 78U emit a spray of liquid upwardly into the upper dish rack 24. While no central apertures 78C are shown for clarity, it is understood that this embodiment can optionally include the central apertures 78C that emit a spray of liquid arcing into the lower dish rack 26 as described for FIGS. 4-5.

In the illustrated embodiment, the group of lower apertures 78L is located on a lower portion of the periphery 106 of the sprayer 80 and oriented to spray liquid in a path along a substantially downward angle relative to the sprayer 80, and the group of upper apertures 78U is located on an upper portion of the periphery 106 and oriented to spray liquid in a path along a substantially upward angle relative to the sprayer 80. While each group is shown as including multiple apertures 78, any of the groups could instead include a single aperture.

At least one of the upper apertures 78U emits a spray of liquid upwardly into at least one of the four corners 108-114 of the upper dish rack 24. As shown, the left side sprayer 80 has at least one upper aperture 78U which emits a spray of liquid into the left front corner 108, the left rear sprayer 80 has at least one upper aperture 78U which emits a spray of liquid into the left rear corner 110, right left rear sprayer 80 has at least one upper aperture 78U which emits a spray of liquid into the right rear corner 112, and the right side sprayer 80 has at least one upper aperture 78U which emits a spray of liquid into the right front corner 114.

The upper sprayer 32 shown in FIG. 1 may provide adequate coverage of the central portion of the upper disk rack 24, leaving the perimeter of the dish rack 26 to be covered by the manifold 76. More specifically, the upper dish rack 24 can be conceptually divided into multiple perimeter zones, with an exemplary glass A-I shown in each zone. The upper apertures 78U on the left side sprayer 80 emit a spray of liquid directly into the zones A-D to clean the dish(es), shown herein as a single glass, contained in each zone A-D. The upper apertures 78U on the left rear sprayer 80 emit a spray of liquid directly into the zones E-I to clean the dish(es), shown herein as a single glass, contained in each zone E-I. A similar zonal coverage pattern may be provided by the right side and rear sprayers 80. Other apertures 78 on the sprayers 80 may emit liquid to other zones of the upper dish rack 24.

The silverware basket 25 is shown as being located on the right side 130 of the lower dish rack 25, and one or more of the lower apertures 78L can be configured to emit liquid into the silverware basket 25. The right side sprayer 80 may emit liquid into one or more zones SWA, SWB, SWC of the silverware basket 25. As shown the right rear sprayer 80 has at least one lower aperture 78L which emits a spray of liquid into the first zone SWA and the right side sprayer 80 has at least two lower apertures 78L which respectively emit a spray of liquid into the second and third zones SWB, SWC. Other apertures 78 on the sprayers 80 may emit liquid to other zones of the lower dish rack 26.

Figure 7:
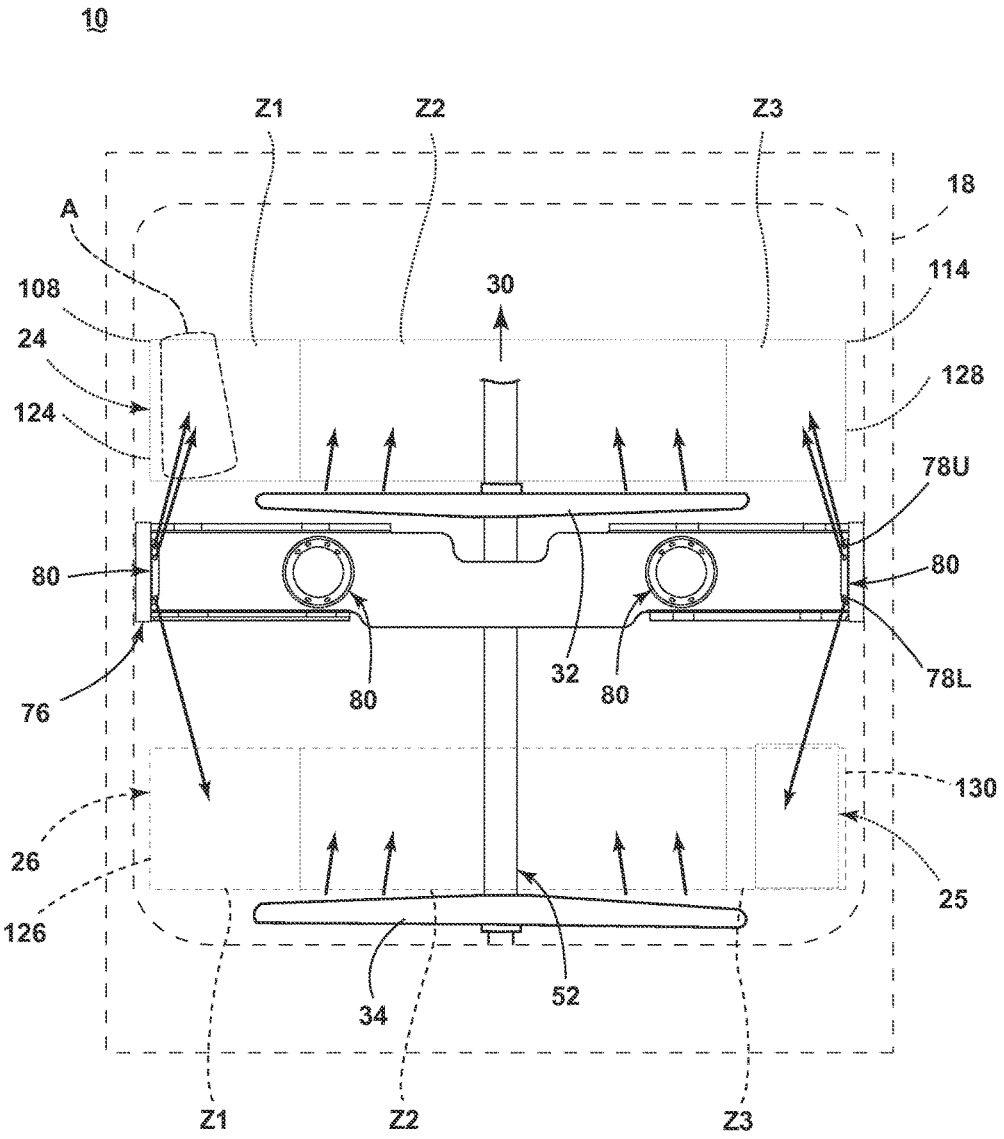
FIG. 7 is a front view of the dishwasher of FIG. 6, showing the pattern of liquid emitted from the manifold.

FIG. 7 is a front view of the dishwasher 10 of FIG. 6, showing the pattern of liquid emitted from the manifold 76. In FIG. 7, only the spray patterns of liquid emitted from the left and ride side sprayers 80 are illustrated for clarity. The dish racks 24, 26 can be conceptually divided into multiple zones, including a first zone Z1 near the left side 124, 126 of the racks 24, 26, a second zone Z2 near a central portion of the racks 24, 26, and a third zone Z3 adjacent the right side 128, 130 of the racks 24, 26. The second zone Z2 of the upper rack 24 can be treated by the upper rotatable sprayer 32 while the second zone Z2 of the lower rack 26 can be treated by the lower rotatable sprayer 34. The first and third zones Z1, Z3 may extend around at least a portion of the perimeter of the racks 24, 26 and may include the corners 108-122 of each rack 24, 26. The first zone Z1 can be treated by the left side and left rear sprayers 80 of the manifold 76, which the third zone can be treated by the right side and right rear sprayers 80 of the manifold 76.

Figure 8:
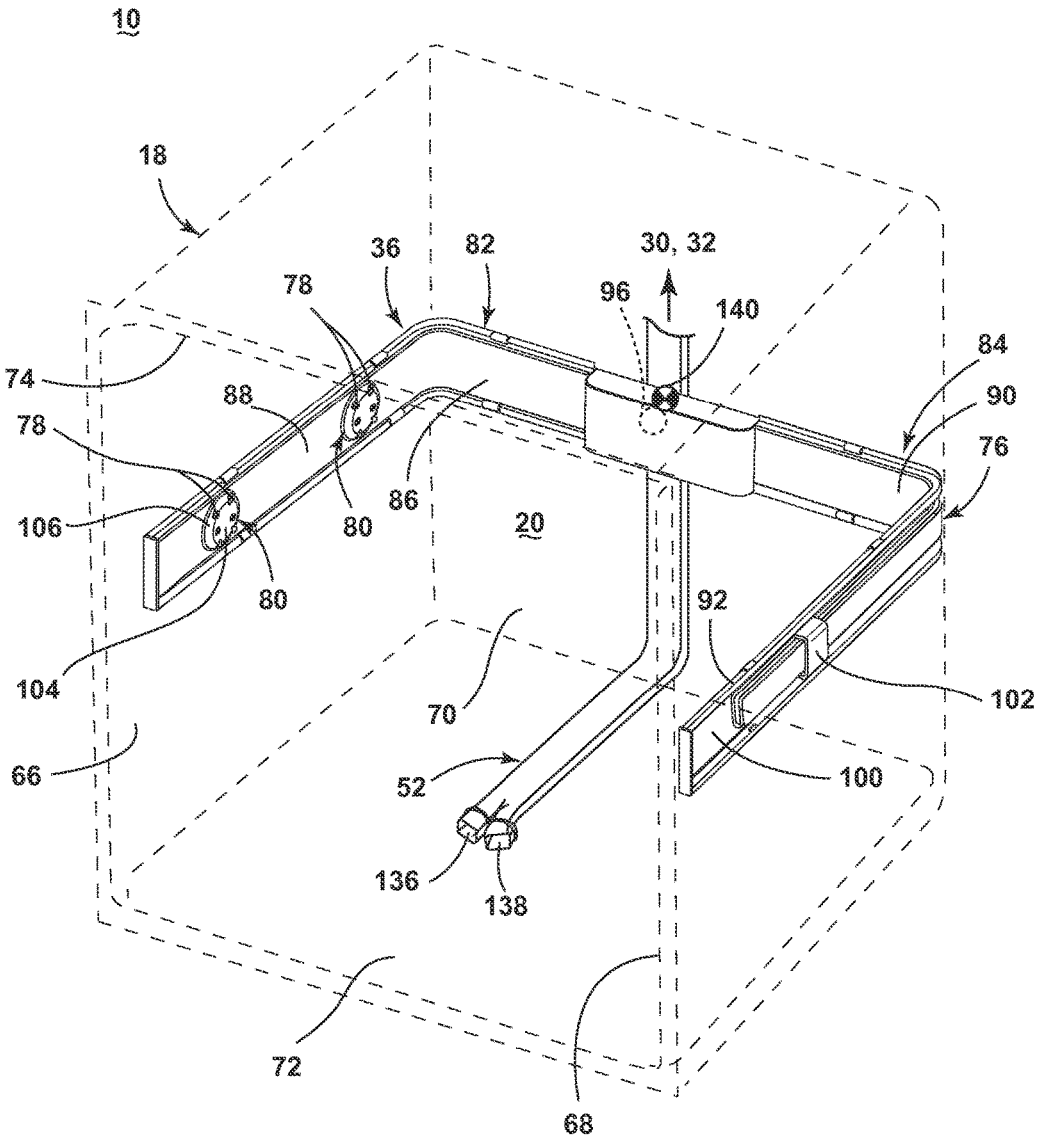
FIG. 8 is a perspective of a dishwasher, with internal components removed for clarity to show a manifold, according to a third embodiment of the invention.

For FIGS. 7-8, it is understood that the lines drawn from the apertures 78 represent the main flow path for the emitted liquid, and that some emitted liquid may deviate from the main flow path along a higher or lower trajectory than depicted in the figures in order to effect good coverage of the racks 24, 26 and silverware basket 25. Likewise, the lines drawn from the sprayers 32, 34 represent the main flow path for the emitted liquid, and that some emitted liquid may deviate from the main flow path along a wider or narrower trajectory than depicted in the figures in order to effect good coverage of the racks 24, 26 and silverware basket 25.

FIG. 8 is a perspective of a dishwasher, with internal components removed for clarity to show a manifold 76 of a dishwasher 10 according to a third embodiment of the invention. The third embodiment can be substantially similar to the first embodiment, but differs in the configuration of the manifold 76 and the supply tube 52. Here, the sprayers 80 are rotatable with respect to the manifold 76, and are arranged in pairs on the left and right side segments 88, 92 of the manifold 76, with no sprayers 80 provided on the rear segments 86, 90; however, other arrangements of rotatable sprayers 80 are possible.

The sprayers 80 are rotatably mounted to the manifold 76 such that emission of liquid from the apertures 78 causes the sprayers 80 to spin. For the four side sprayers 80 illustrated, the apertures 78 can be configured to emit liquid in substantially either spray pattern shown above for the first and second embodiments in FIGS. 4-7. However, since the sprayers 80 rotate, the spray patterns may be dynamic rather than substantially static as with the patterns for the fixed sprayers 80 of the first and second embodiments since the rotation of the sprayers 80 cyclically changes the orientation of the apertures 78. For example, the apertures 78 on the periphery 106 of the sprayers 80 may treat different corners and sides of the racks 24, 26 as sprayers 80 rotate and the spray direction changes, while the apertures 78 on the face 104 of the sprayers 80 may treat the middle of the racks 24, 26 as the sprayers 80 rotate and the spray direction changes.

Figure 9:
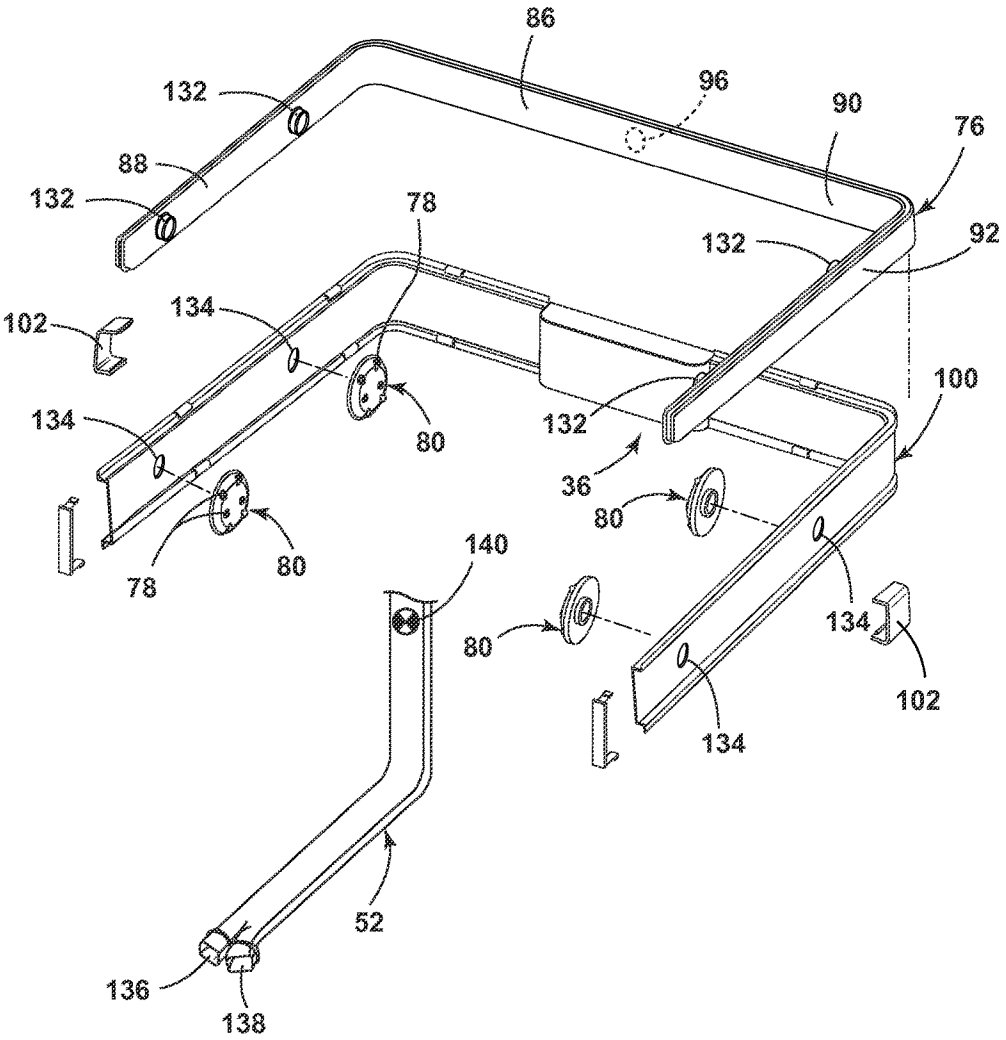
FIG. 9 is an exploded view of the manifold from FIG. 8.

FIG. 9 is an exploded view of the manifold from FIG. 8. The manifold 76 is provided with a separate cover 100, with the manifold 76 provided on interior of tub 18, and the cover 100 mounted over the manifold 76. The manifold 76 is provided with several ports 132 in fluid communication with the supply tube 52. The ports 132 can protrude through openings 134 in the cover 100 in order to couple with and provide fluid to the sprayers 80.

In the third embodiment, the supply tube 52 is a dual-feed tube having a first passage 136 extending to the manifold 76 and a second passage 138 extending to the upper rotatable sprayer 32 and top sprayer 30. A valve 140 can be provided to control the flow of wash liquid to either or both of the passages 136, 138 for controlling the delivery of liquid to the manifold 76 and the top and upper sprayers 30, 32. The valve 140 can be configured to permit liquid delivery to both passages 136, 138 at one time, only to the first passage 136, or only to the second passage 138. The valve 140 can be operably coupled with the controller 14 (FIG. 2) and may be automatically controlled according to the cycle of operation. Alternatively or additionally, an operational control for selecting the manifold spray action can be provided on the user interface 16 to allow the user to manually select to use the manifold 76 for a cycle. While shown as being positioned at substantially the same height as the manifold 76, the valve 140 can be positioned anywhere in the supply tube 52 which permits the valve 140 to control the delivery of liquid to the passages 136, 138. It should be noted that any of the embodiments of the dishwasher 10 discussed herein can incorporate the dual feed supply tube 52.

Figure 10:
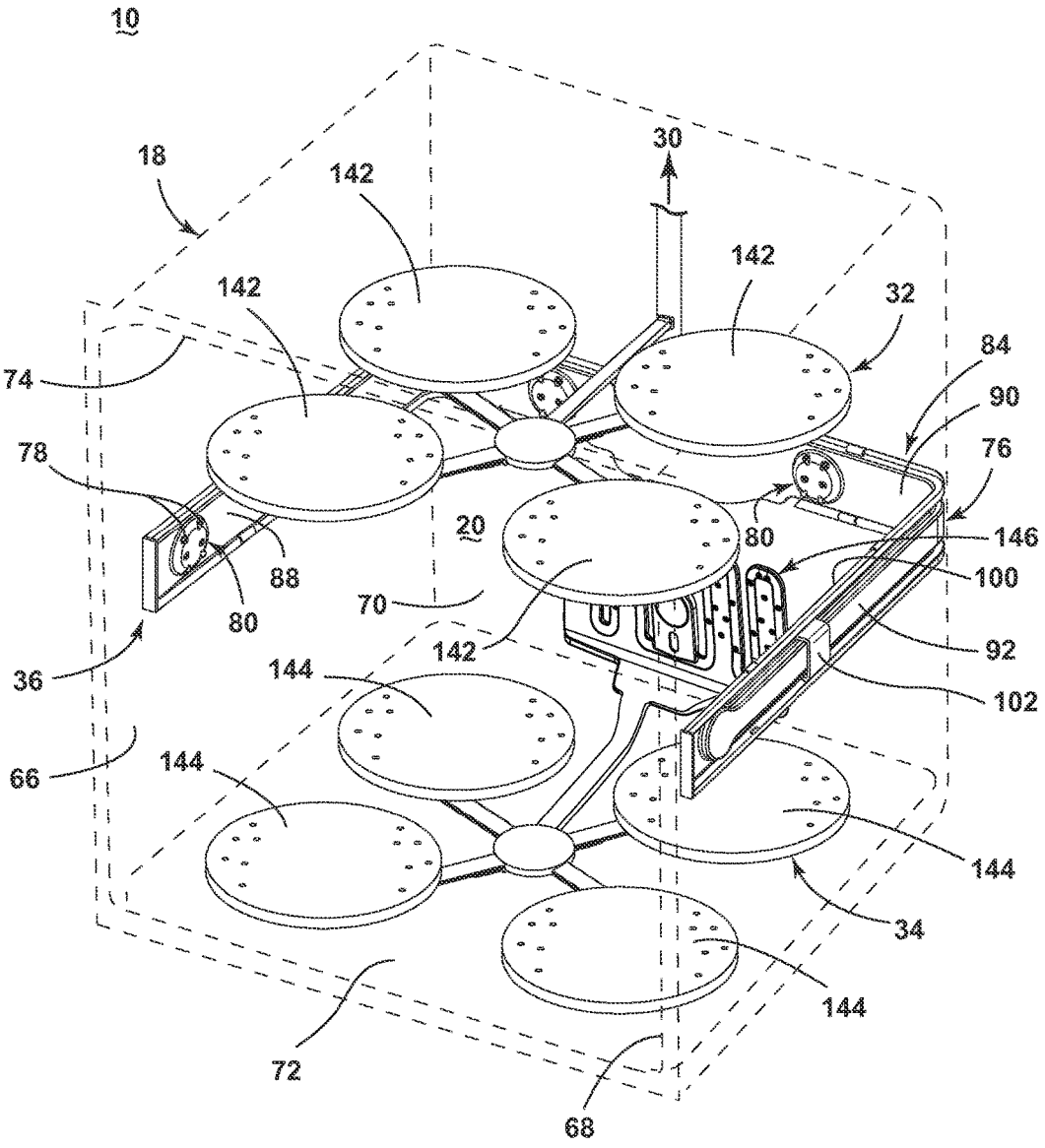
FIG. 10 is a perspective of a dishwasher, with internal components removed for clarity, according to a fourth embodiment of the invention.

FIG. 10 is a perspective of a dishwasher 10, with internal components removed for clarity, according to a fourth embodiment of the invention. The fourth embodiment can be substantially similar to the first embodiment, but differs in the configuration of the other sprayers of the spraying system 28. In the fourth embodiment, the upper rotatable sprayer 32 is illustrated as a group of four rotating spray discs 142 rather than a single rotating spray arm. Likewise the lower rotatable sprayer 34 is illustrated as a group of four rotating spray discs 144 rather than a single rotating spray arm. Furthermore, the spraying system 28 is provided with an additional sprayer in the form of an additional spray manifold 146 provided on the rear wall 70 of the tub 18 below the manifold 76. One example of a suitable spray manifold 146 is disclosed in U.S. Patent Application Publication No. 2013/0092194, published Apr. 18, 2013, now U.S. Pat. No. 9,119,517, which is incorporated herein by reference in its entirety. Like the upper manifold 76, the lower spray manifold 146 can be supplied with liquid by the supply tube 52. The manifolds 76, 146 can be fed via a common passage, or the supply tube 52 can be provided with separate passages for each manifold 76, 146. It should be noted that any of the embodiments of the dishwasher 10 discussed herein can incorporate the rotating spray discs 142, 144 and additional spray manifold 146 shown for the fourth embodiment, and is not just limited to applying to the first embodiment. It is also noted that the apertures 78 of the manifold 76 can be configured to emit liquid in substantially either spray pattern shown above for the first and second embodiments in FIGS. 4-7.

Any of the manifolds 76 and other sprayers of the spraying systems 28 disclosed herein can be configured to have a spray pattern that differs from those already disclosed. The spray patterns can differ based on the racks or zones to be covered, the number of racks within the dishwasher 10, and the location of the racks within the dishwasher. FIGS. 11-14 show some examples of different spray patterns.

Figure 11:
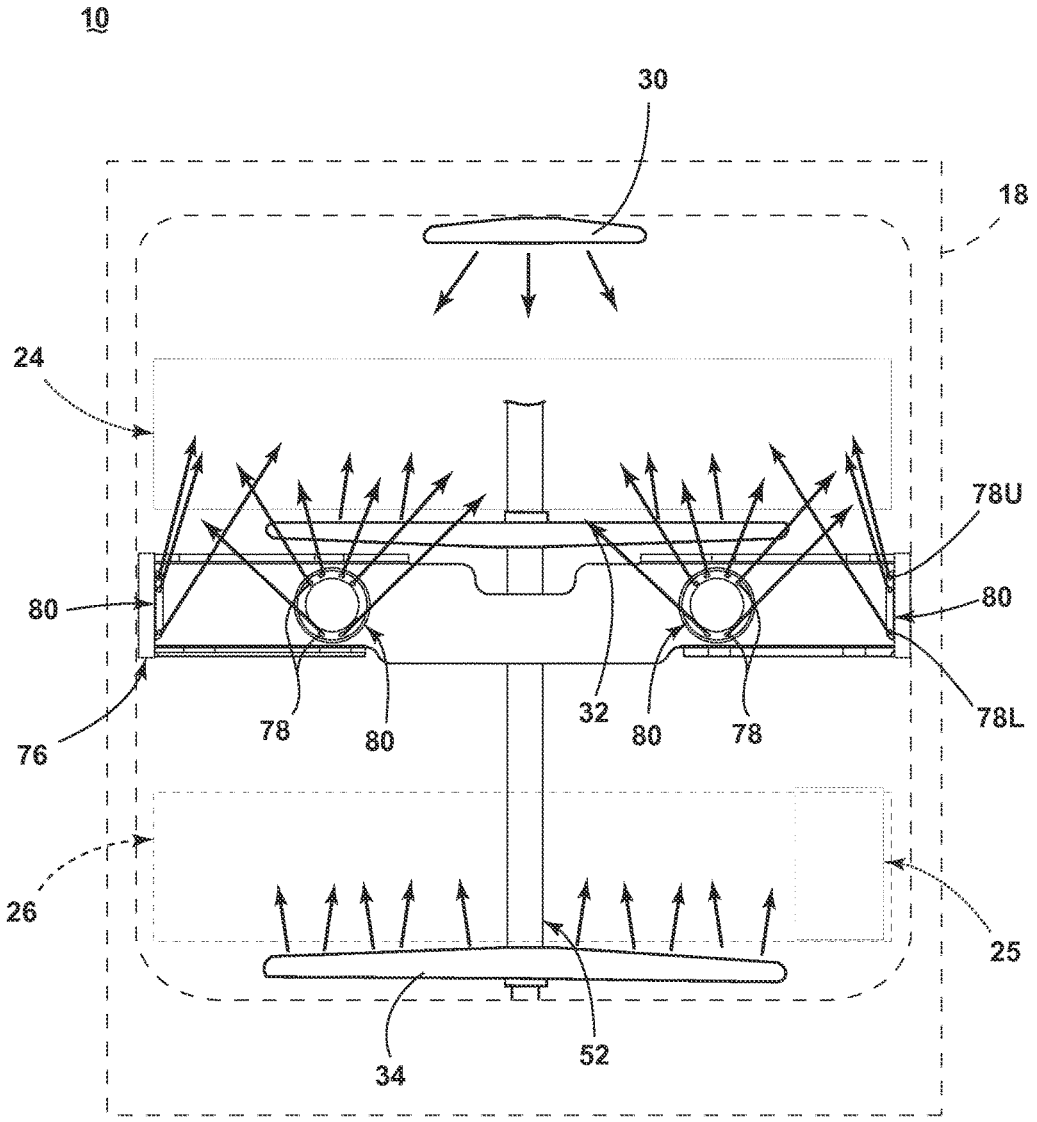
FIG. 11 is a schematic, front view of a dishwasher according to a fifth embodiment of the invention, showing a spray pattern of liquid emitted from the spraying system.

FIG. 11 is a schematic, front view of a dishwasher 10 according to a fifth embodiment of the invention. For the fifth embodiment, apertures 78 of the manifold 76 are oriented to emit a spray of liquid substantially all toward the upper rack 24. The apertures 78 can be directed toward different areas of zones of the upper rack 24, including, but not limited to, the four corners of the upper rack 24, the four sides of the upper rack, and various subsections of the central portion of the upper rack 24.

Figure 12:
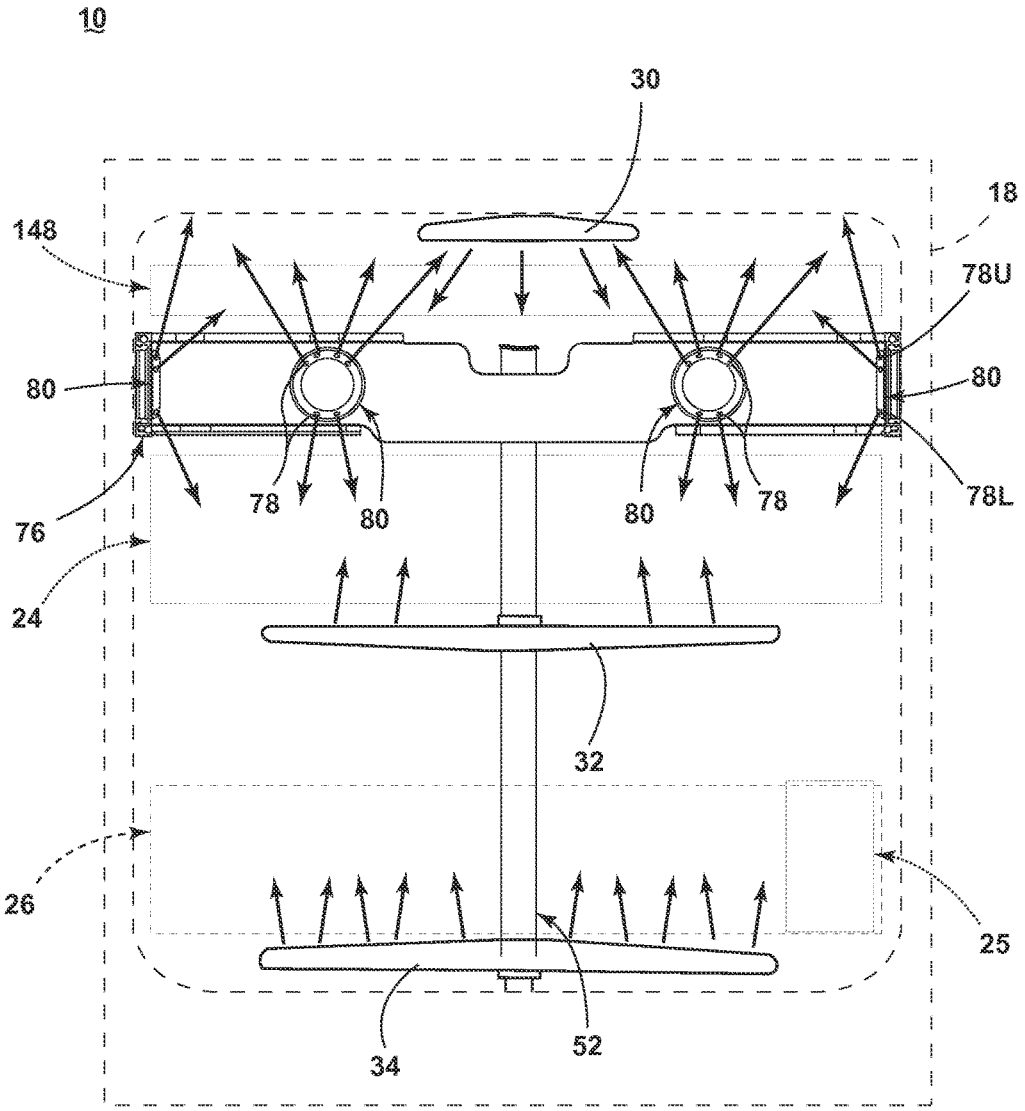
FIG. 12 is a schematic, front view of a dishwasher according to a sixth embodiment of the invention, showing a spray pattern of liquid emitted from the spraying system.

FIG. 12 is a schematic, front view of a dishwasher 10 according to a sixth embodiment of the invention. For the sixth embodiment, a third dish holder in the form of a top rack 148 is located within the treating chamber 20 above the upper rack 24 and receives dishes for being treated. The rack 148 can be mounted for slidable movement in and out of the treating chamber 20 for ease of loading and unloading. The top rack 148 can be provided in place of or in addition to the silverware basket 25, but may be configured to receive any type of dish for treatment, not just utensils. Other numbers and configurations of racks are also possible.

The manifold 76 may be fixedly mounted to the tub 18 between the upper rack 24 and the top rack 148, and may emit liquid toward one or both of the racks 24, 148. As illustrated, the manifold 76 is configured to emit liquid toward both of the racks 24, 148, with the apertures 78 of the manifold 76 configured to spray in different directions in order to provide full coverage of the dishes being treated. For example, groups of lower apertures 78L emit a spray of liquid downwardly into the upper rack 24 while groups of upper apertures 78U emit a spray of liquid upwardly into the top rack 148. While not shown, the dish racks 24, 148 can be conceptually divided into multiple zones, which can be treated by different apertures 78 or groups of apertures 78 on the manifold 76.

Figure 13:
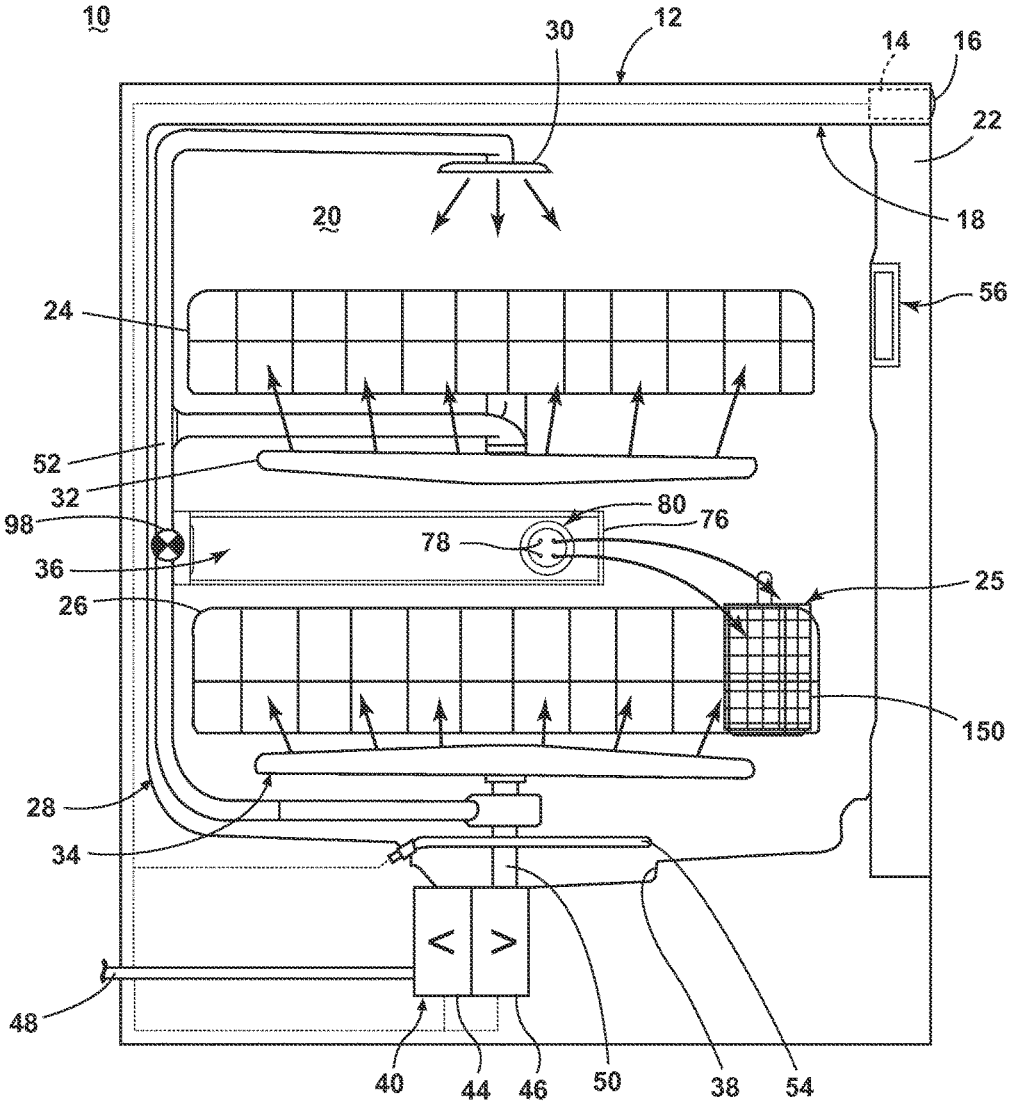
FIG. 13 is a schematic, cross-sectional view of a dishwasher according to a seventh embodiment of the invention, showing a spray pattern of liquid emitted from the spraying system.

FIG. 13 is a schematic, cross-sectional view of a dishwasher 10 according to a seventh embodiment of the invention. For the seventh embodiment, the silverware basket 25 is located along a front side 150 of the lower rack 26, and at least some of the apertures 78 of the manifold 76 are oriented to emit a spray of liquid toward the silverware basket 25 at the front of the lower rack 26. Another possible location for the silverware basket 25 for treatment by the manifold 76 is the upper rack 26.

As shown, the at least one of the apertures 78 on the side nozzles 80 of the manifold (only one of which is visible in FIG. 13) can be configured to spray toward the silverware basket 25. Depending on factors such as the distance between the sprayer 80 and the basket 25 and the pressure of emitted liquid, the apertures 78 can be configured to spray liquid in a path along a substantially downward angle relative to the sprayer 80 or along a substantially outward curve relative to the sprayer 80. The sprayers 80 may emit liquid into different zones of the silverware basket 25 to ensure complete coverage of the basket 25. Other apertures 78 on the sprayers 80 may emit liquid to other zones of the other dish racks 24, 26.

Figure 14:
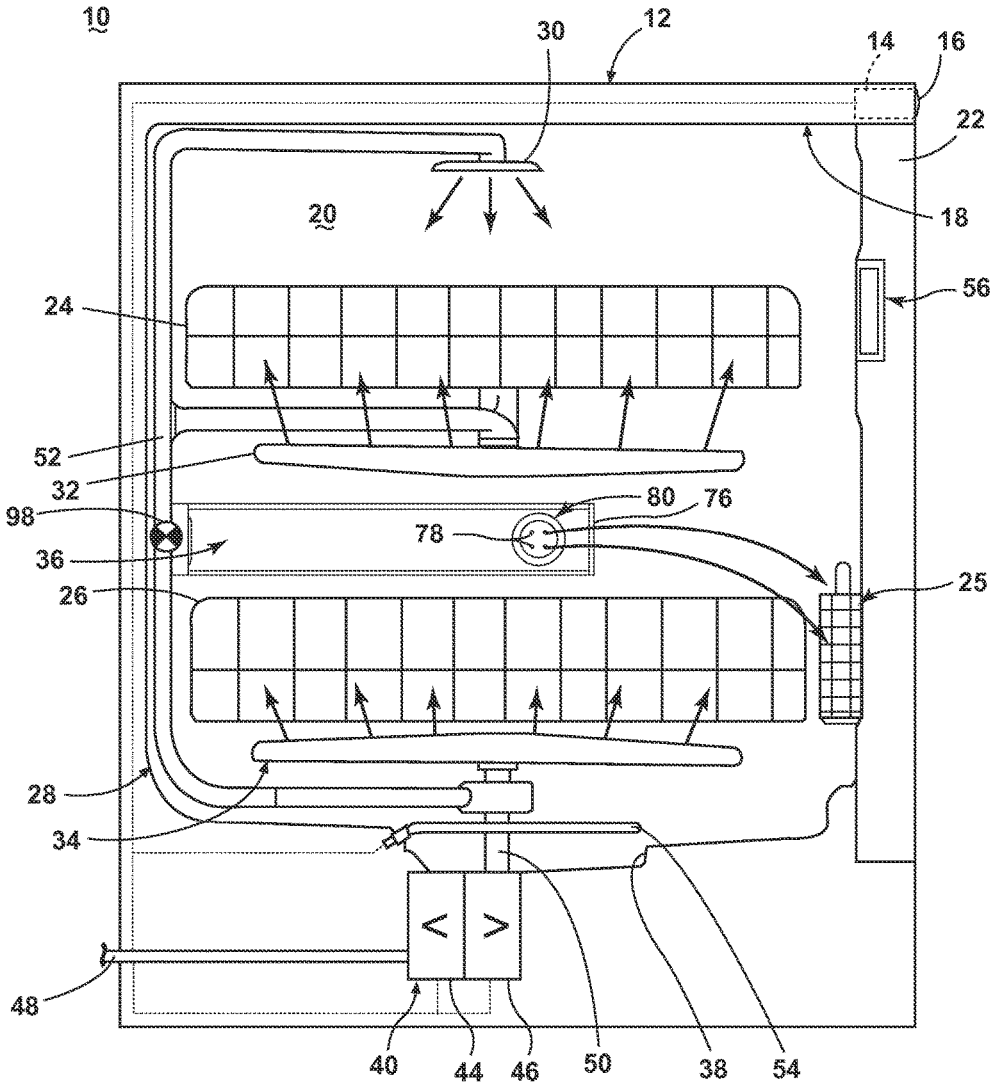
FIG. 14 is a schematic, cross-sectional view of a dishwasher according to an eighth embodiment of the invention, showing a spray pattern of liquid emitted from the spraying system.

FIG. 14 is a schematic, cross-sectional view of a dishwasher 10 according to an eighth embodiment of the invention. For the eighth embodiment, the silverware basket 25 is located on an inner surface of the door 22, and at least some of the apertures 78 of the manifold 76 are oriented to emit a spray of liquid toward the silverware basket 25 on the door 22. As shown, the at least one of the apertures 78 on the side nozzles 80 of the manifold (only one of which is visible in FIG. 14) can be configured to spray toward the silverware basket 25. Depending on factors such as the distance between the sprayer 80 and the door 22 and the pressure of emitted liquid, the apertures 78 can be configured to spray liquid in a path along a substantially downward angle relative to the sprayer 80 or along a substantially outward curve relative to the sprayer 80. The sprayers 80 may emit liquid into different zones of the silverware basket 25 to ensure complete coverage of the basket 25. Other apertures 78 on the sprayers 80 may emit liquid to other zones of the other dish racks 24, 26.

Figure 15:
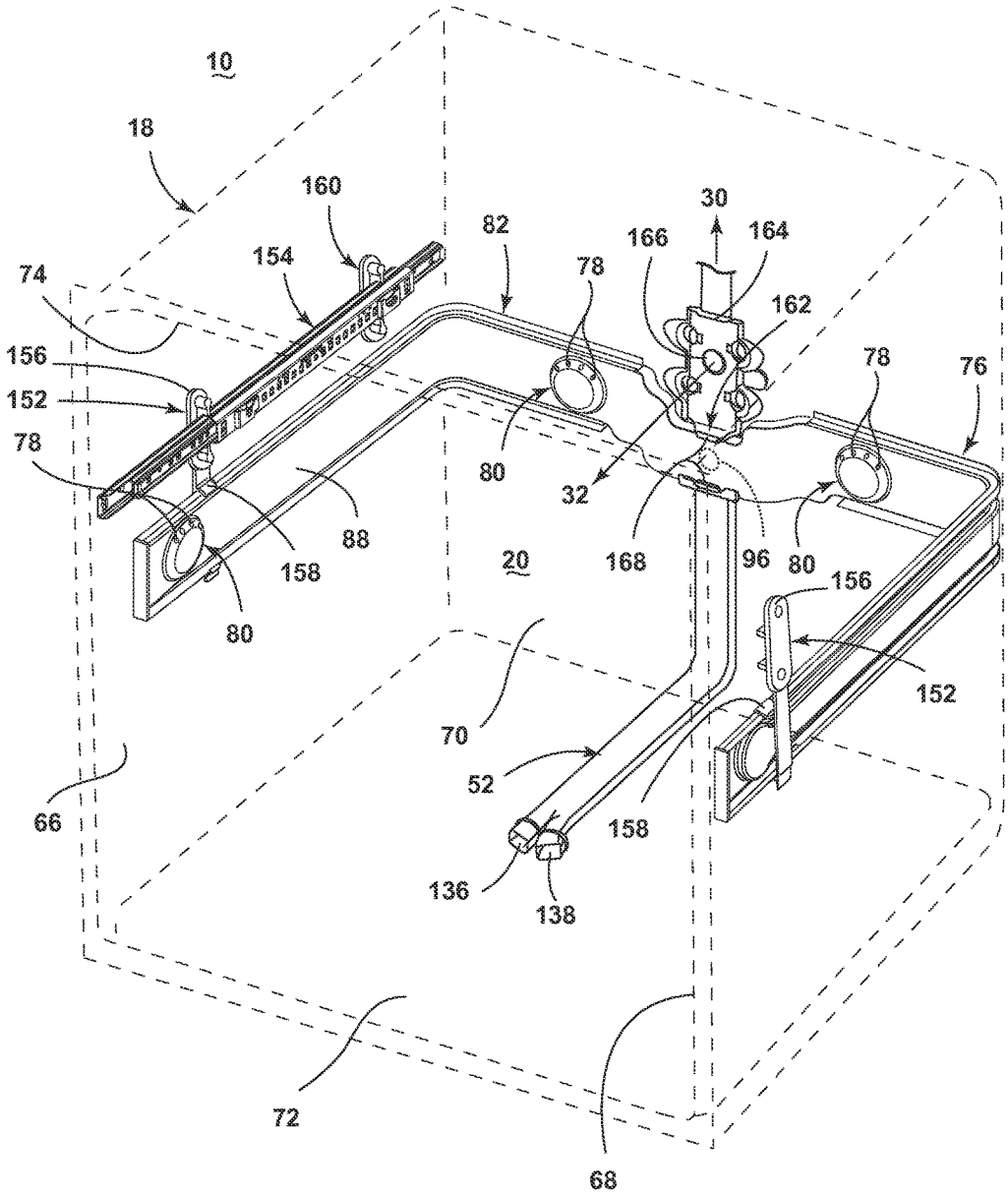
FIG. 15 is a schematic, perspective of a dishwasher, with internal components removed for clarity to show a manifold, according to a ninth embodiment of the invention.

FIG. 15 is a schematic, perspective of a dishwasher 10, with internal components removed for clarity, according to a ninth embodiment of the invention. The ninth embodiment includes a particular mounting arrangement for the manifold 76 that can be used with any of the previous embodiments of the manifold 76. The mounting arrangement includes one or more brackets 152 which double as rail brackets for a rail system of one of the racks 24, 26 (FIG. 1) which mounts the rack 24, 26 for slidable movement in and out of the treating chamber 20. Here, the manifold 76 is mounted to the tub 18 by rail brackets 152 for sliding rails 154 of the upper rack 24, which are positioned on the left and right side walls 66, 68 of the tub 18 (though only the rail 154 on the left side wall 66 is shown in FIG. 15 for clarity). Each rail bracket 152 includes a rail holder 156 for retaining the sliding rail 154 and a manifold holder 158 for retaining the manifold 76. The manifold holder 158 can be formed as an extension from the rail holder 156, and can extend downwardly from the bottom of the rail holder 156. Of course, if the rail bracket 152 is configured for the lower rack 26, the manifold holder 158 can extend upwardly from the top of the rail holder 156. The rail system can also include one or more additional brackets 160 which do not include the extension and thus only mounts the sliding rails 154 to the tub 18. The brackets 152, 160 can be attached to the tub 18 in any suitable manner, including, but not limited to, mechanical fasteners such as screws or bolts, or welding.

The mounting arrangement can further include a retainer 162 formed on a coupling 164 which includes a port 166 supplying liquid from the supply tube 52 to the upper rotatable sprayer 32. The sprayer 32 is automatically coupled with the port 166 when the upper rack 24 (FIG. 1) is slid into the treating chamber 20. The supply tube 52 shown in FIG. 15 is a dual-feed tube, with the first passage 136 extending to the manifold 76 and the second passage 138 extending to the upper rotatable sprayer 32 via the port 166 and also to top sprayer 30. The retainer 162 includes upper and lower tabs 168 which can snap-fit the manifold 76.

There are several advantages of the present disclosure arising from the various features of the apparatuses described herein. For example, the embodiment of the invention described above allows for more complete spray coverage of the treating chamber. Typical spraying systems for dishwashers are limited to spraying from the bottom up and/or the top down for a primarily vertical spray path. This limitation creates areas of limited coverage, particularly in the corners of the dish racks and the silverware basket. The embodiments of the present invention described herein provides a manifold with directional apertures dedicated to different areas of the treating chamber, including the corners of the dish rack and the silverware basket.

Another advantage is that the embodiment of the invention described above allows more intense coverage of the lower dish rack. While some attempts have been made to provide more full coverage in the lower dish rack be providing additional spray zones, these are often not effective during operation because the way in which the user loads dishes. It is common practice for many users of dishwasher to load larger, bulkier, and/or more heavily solid dishes in the lower rack, and these dishes can block some of the spray from the additional zones. The embodiments of the present invention described herein provides a manifold with directional apertures dedicated to different areas of the lower dish rack, including directly spraying into the lower dish rack, and spraying in the arcing curve in order to cover the middle section of the lower dish rack.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher comprising:

a tub at least partially defining a treating chamber and having an open face providing access to the treating chamber and a sump;

a door selectively closing the open face;

a lower dish rack located within the treating chamber;

an upper dish rack located within the treating chamber above the lower dish rack;

a spraying system comprising:

a lower rotating sprayer located within the treating chamber beneath the lower dish rack;

an upper rotating sprayer located within the treating chamber beneath the upper dish rack; and a manifold located within the treating chamber and having a first sprayer comprising a face defining a periphery, wherein the first sprayer includes at least one first aperture disposed on a lower portion of the periphery and at least one second aperture disposed on the face of the first sprayer; and a recirculation system for recirculating liquid sprayed in the treating chamber from the sump to the spraying system;

wherein the at least one first aperture is configured to emit a spray of liquid at a first trajectory along a substantially downward angle relative to the first sprayer such that it is configured to be directly sprayed into a first zone in the lower dish rack and the at least one second aperture is configured to emit a second trajectory spray of liquid that is along a substantially outward curve relative to the first sprayer such that it is configured to arc into the lower dish rack into a second zone, different than the first zone.

2. The dishwasher of claim 1, wherein more than one aperture of the at least one first aperture is configured to emit a spray of liquid directly onto a dish adjacent to the manifold in the lower dish rack and more than one aperture of the at least one second aperture is configured to emit an arcing spray of liquid over the dish adjacent to the manifold in the lower dish rack.

3. The dishwasher of claim 1, wherein the upper dish rack has four corners and the first sprayer includes at least one third aperture disposed on an upper portion of the periphery and configured to emit a spray of liquid upwardly into at least one of the four corners of the upper dish rack.

4. The dishwasher of claim 1 and further comprising a silverware basket located in the lower dish rack, wherein the at least one first aperture is configured to emit a spray of liquid directly into the silverware basket such that it directly sprays onto a dish located in the silverware basket.

5. The dishwasher of claim 1, wherein the manifold is provided between the lower and upper dish racks.

6. The dishwasher of claim 1, wherein the tub comprises at least one side wall connected to a rear wall, and the manifold extends along at least one of the side wall and the rear wall.

7. The dishwasher of claim 6, wherein the manifold extends along both of the side wall and the rear wall.

8. The dishwasher of claim 7, wherein the manifold further comprises a second sprayer with multiple apertures fluidly coupled to the recirculation system, wherein one of the first and second sprayers is provided on the rear wall and the other of the first and second sprayers is provided on the side wall.

9. The dishwasher of claim 8, wherein the manifold further comprises a third sprayer with multiple apertures fluidly coupled to the recirculation system, and the third sprayer is provided on the rear wall.

10. The dishwasher of claim 1, wherein the recirculation system comprises a supply tube coupled to the sump and extending to the manifold.

11. The dishwasher of claim 10, wherein the manifold defines a passageway, and the at least one first and at least one second apertures are fluidly coupled to the supply tube via the passageway.

12. The dishwasher of claim 10, wherein the supply tube further extends to the upper rotating sprayer.

13. The dishwasher of claim 12, wherein the supply tube comprises a first passage extending to the manifold and a second passage extending to the upper rotating sprayer.

14. The dishwasher of claim 13 and further comprising a valve configured to direct a flow of wash liquid either to the first passage or the second passage.

15. The dishwasher of claim 12, wherein the recirculation system further comprises a pump assembly and the supply tube extends rearwardly from the pump assembly to a rear wall of the tub and upwardly to supply liquid to the manifold and the upper rotating sprayer.

16. The dishwasher of claim 10, wherein the manifold comprises two opposing portions configured to selectively receive liquid through the supply tube and the two opposing portions are positioned on opposite sides of the supply tube, with each portion extending laterally from the supply tube.

17. The dishwasher of claim 16 wherein the manifold further comprises a second sprayer with multiple apertures fluidly coupled to the recirculation system, and the first and second sprayers are located on a different one of the two opposing portions.

18. The dishwasher of claim 1, and further comprising a cover extending over the manifold, wherein the first sprayer is provided on an exterior of the cover.

19. The dishwasher of claim 1, wherein the first sprayer is rotatably mounted to the manifold and is configured to rotate relative to the manifold by emission of liquid from the at least one first and at least one second apertures.

20. The dishwasher of claim 1, wherein the first sprayer is fixedly mounted to the manifold and is configured to remain stationary relative to the manifold when liquid is emitted from the at least one first and at least one second apertures.

21. The dishwasher of claim 1, wherein the lower and upper rotating sprayers each comprise at least one rotating spray arm.

22. The dishwasher of claim 1, wherein the lower and upper rotating sprayers each comprise multiple rotating spray discs.

23. The dishwasher of claim 1 wherein the spray of liquid at the first trajectory does not intersect the spray of liquid at the second trajectory in the lower dish rack.

24. The dishwasher of claim 1, wherein the manifold further comprises a second sprayer with multiple apertures, wherein the first sprayer is located on a first side of the lower dish rack and the second sprayer is located on a second side of the lower dish rack opposite the first side.

25. The dishwasher of claim 24, wherein at least one of the multiple apertures of the second sprayer is configured to emit an arcing spray of liquid into the lower dish rack, with the arcing sprays of liquid from the first sprayer and the second sprayer at least reaching a middle of the lower dish rack.

26. The dishwasher of claim 1, wherein the face defines a planar surface and the periphery includes a surface intersecting the face at an angle.

* * * * *